US008278808B2

(12) United States Patent
Lykowski

(10) Patent No.: US 8,278,808 B2
(45) Date of Patent: Oct. 2, 2012

(54) METALLIC INSULATOR COATING FOR HIGH CAPACITY SPARK PLUG

(75) Inventor: James D. Lykowski, Temperance, MI (US)

(73) Assignee: Federal-Mogul Worldwide, Inc., Southfield, MI (US)

( * ) Notice: Subject to any disclaimer, the term of this patent is extended or adjusted under 35 U.S.C. 154(b) by 999 days.

(21) Appl. No.: 11/673,815

(22) Filed: Feb. 12, 2007

(65) Prior Publication Data

US 2007/0188063 A1 Aug. 16, 2007

Related U.S. Application Data

(63) Continuation-in-part of application No. 11/352,708, filed on Feb. 13, 2006, now abandoned.

(51) Int. Cl.
*H01T 13/20* (2006.01)

(52) U.S. Cl. ..... 313/141

(58) Field of Classification Search ..... 313/118–145
See application file for complete search history.

(56) References Cited

U.S. PATENT DOCUMENTS

| | | | | |
|---|---|---|---|---|
| 3,522,465 | A | 8/1970 | Knippenberg et al. | |
| 3,683,232 | A | 8/1972 | Baur | |
| 4,433,092 | A | 2/1984 | Nemeth | |
| 4,568,855 | A | 2/1986 | Nemeth et al. | |
| 4,692,657 | A | 9/1987 | Grunwald et al. | |
| 4,746,834 | A * | 5/1988 | Bauerle et al. | 313/137 |
| 4,751,430 | A | 6/1988 | Muller et al. | |
| 4,774,914 | A | 10/1988 | Ward | |
| 4,914,344 | A | 4/1990 | Watanabe et al. | |
| 4,939,409 | A | 7/1990 | Friese et al. | |
| 5,210,458 | A | 5/1993 | McDougal | |
| 5,272,415 | A | 12/1993 | Griswold et al. | |
| 5,405,280 | A | 4/1995 | Polikarpus et al. | |
| 5,507,264 | A | 4/1996 | Kugler et al. | |

(Continued)

FOREIGN PATENT DOCUMENTS

CN 2398751 Y 9/2000

(Continued)

*Primary Examiner* — Nimeshkumar Patel
*Assistant Examiner* — Christopher Raabe
(74) *Attorney, Agent, or Firm* — Robert L. Stearns; Dickinson Wright, PLLC

(57) ABSTRACT

A spark plug (24) is used in an ignition system (10) of the type for creating a precisely timed spark to ignite an air/fuel mixture in an internal combustion engine. The spark plug (24) is provided with an integrated capacitor feature to increase the intensity of its spark. The capacitor feature is formed by applying metallic film (62, 64) to the inner (30) and outer surfaces of a tubular insulator (26). The insulator (26), made from an alumina ceramic material, forms a dielectric and sustains an electrical charge when an electrical differential is established between the inner (64) and outer (62) metallic films. The stored electrical charge is discharged with the firing of a spark in the spark gap (54). The inner (64) and outer (62) metallic films can be applied as a paint or ink directly to the surfaces of the insulator (26), or can be mixed with a glazing compound to form conductive coatings simultaneous with the glazing operation. Ganged (62') or serpentine (62") micro-plates can be formed within either or both of the inner and outer metallic films to increase the charge-carrying surface area. The metallic film (62, 64) is specially selected from materials that will not migrate into the porous matrix of the ceramic insulator (26). The metallic film (62, 64) is preferably gold, platinum, copper, or a platinum group metal.

22 Claims, 7 Drawing Sheets

U.S. PATENT DOCUMENTS

| | | | |
|---|---|---|---|
| 5,523,138 | A | 6/1996 | Chinzi |
| 5,731,654 | A | 3/1998 | Benedikt et al. |
| 5,859,491 | A | 1/1999 | Nishikawa et al. |
| 6,060,821 | A | 5/2000 | Suzuki et al. |
| 6,137,211 | A | 10/2000 | Sugimoto et al. |
| 6,191,525 | B1 | 2/2001 | Tanaka et al. |
| 6,329,743 | B1 | 12/2001 | Camilli |
| 6,455,988 | B1 | 9/2002 | Weber et al. |
| 6,557,508 | B2 | 5/2003 | Labarge et al. |
| 6,617,769 | B2 | 9/2003 | Suzuki |
| 6,693,053 | B2 | 2/2004 | Geier et al. |
| 6,771,009 | B2 | 8/2004 | Nishikawa et al. |
| 2001/0007196 | A1 | 7/2001 | Sugimoto et al. |
| 2003/0184201 | A1 | 10/2003 | Roessler et al. |
| 2004/0004425 | A1 | 1/2004 | Labarge et al. |
| 2005/0241627 | A1* | 11/2005 | Ward ..... 123/634 |
| 2007/0262721 | A1 | 11/2007 | Camilli |
| 2008/0018216 | A1 | 1/2008 | Camilli |

FOREIGN PATENT DOCUMENTS

| | | | |
|---|---|---|---|
| JP | S63501520 | A | 6/1988 |
| JP | 02098085 | | 4/1990 |
| WO | WO8701767 | A1 | 3/1987 |

* cited by examiner

METALLIC INSULATOR COATING FOR HIGH CAPACITY SPARK PLUG

CROSS REFERENCE TO RELATED APPLICATIONS

The present application is a Continuation-in-Part of and claims priority to U.S. patent application entitled METALLIC INSULATOR COATING FOR HIGH CAPACITY SPARK PLUG having Ser. No. 11/352,708 and filed on Feb. 13, 2006 now abandoned, the entire disclosure of which is hereby incorporated by reference.

BACKGROUND OF THE INVENTION

1. Field of the Invention

The invention relates to an ignition system for a spark-ignited internal combustion engine, and more particularly to a spark plug having high capacitance features.

2. Related Art

Ignition systems for spark-ignited internal combustion engines rely on a spark plug to produce a spark of sufficiently robust discharge so as to ignite a compressed air/fuel mixture. Often, more efficient ignition can be achieved by increasing the intensity of the spark.

The prior art has taught to incorporate a capacitor into the spark plug to increase the intensity of its spark. Various methods and configurations for integrating a capacitor into a spark plug have been proposed. All of the various proposed methods, however, have drawbacks and have failed to meet expectations in real world applications. Some designs integrating capacitors within the spark plug have failed to increase the spark intensity by any appreciable amount. Other designs are not capable of withstanding the high temperature, corrosive operating environment, and as a result their service life is limited. Still an additional limitation of spark plugs with integrated capacitors arises out of their mechanical fragility. These have been found not capable to withstand normal assembly operations without succumbing to chemical oxidation or destruction from collateral mechanical forces and abrasions.

One prior art attempt to achieve a higher capacitance spark plug suggested a metallic silver coating applied to the ID and OD of the alumina ceramic insulator, with the insulator forming an interposed dielectric. While this proposal has certain short term successes, it is subject to failure when used long term at high temperature. The failure mode is a high voltage dielectric failure of the ceramic due to deterioration of the ceramic resulting from migration of the silver into the alumina ceramic and reducing its effectiveness as an electrical insulator. Additionally, this prior design is highly susceptible to chemical oxidation, and the silver coating is not capable of withstanding subsequent assembly operations which include harsh, abrasive contact with machine tools and other elements.

Accordingly, there exists a need for a higher capacitance spark plug which is inexpensive to manufacture, conducive to existing spark plug manufacturing techniques and machinery, not subject to chemical oxidation or mechanical destruction during assembly operations, will not migrate into the matrix of the ceramic insulator, and which provides acceptable service life without deterioration or failure.

SUMMARY OF THE INVENTION

A spark plug for a spark-ignited internal combustion engine comprises a generally tubular ceramic insulator having an outer surface and an inner surface. A metallic shell surrounds at least a portion of the outer surface of the ceramic insulator. The shell includes at least one ground electrode. A center electrode is disposed in the ceramic insulator, in registry with the inner surface thereof. The center electrode has an upper terminal end and a lower sparking end in opposing relation to the ground electrode, with a spark gap defining the space therebetween. The ceramic insulator includes an outer metallic film disposed over at least a portion of its outer surface and in electrical contact with the shell. An inner metallic film is disposed over at least a portion of the inner surface and in electrical contact with the center electrode. The inner and outer metallic films are electrically separated from one another by the ceramic insulator and are operative to store a charge of electrical energy therebetween in response to an electrical potential between the center electrode and the shell.

According to another aspect of the invention, an ignition system for a spark-ignited internal combustion engine is provided. The ignition system comprises an electrical source, an ignition coil operatively connected to the electrical source for creating a high-tension voltage, and a switching device operatively connected to the ignition coil for distributing the high tension voltage from the coil in precisely timed intervals. At least one spark plug is electrically connected to the switching device and includes a generally tubular ceramic insulator having an outer surface and an inner surface. A metallic shell surrounds at least a portion of the outer surface of the ceramic insulator. The shell includes at least one ground electrode. A center electrode is disposed in the ceramic insulator in registry with the inner surface thereof. The center electrode has an upper terminal and a lower sparking end in opposing relation to the ground electrode with a spark gap defining the space therebetween. The ceramic insulator includes an outer metallic film disposed at least over a portion of its outer surface in electrical contact with the shell. An inner metallic film is disposed over at least a portion of the inner surface in electrical contact with the center electrode. The ceramic insulator forms a dielectric between the inner and outer metallic films and is operative to sustain an electrical field therein for discharge with a spark formed in the spark gap.

According to yet another aspect of the invention, a method for forming a spark plug is provided. The method comprises the steps of forming a ceramic insulator as a generally tubular body of revolution having an outer surface and an inner surface; surrounding at least a portion of the outer surface of the ceramic insulator with a metallic shell; attaching a ground electrode to the metallic shell; inserting a center electrode having an upper terminal end and a lower sparking end into the ceramic insulator in registry with its inner surface; and orienting the sparking end of the center electrode opposite to the ground electrode to create a spark gap in the space therebetween. The method is characterized by coating at least a portion of the inner and outer surfaces of the ceramic insulator with metallic film so that the ceramic insulator forms a dielectric between the opposing metallic films and is operative to sustain an electric field therein for discharge with a spark formed in the spark gap.

A spark plug, an ignition system and a method according to the invention result from a spark plug capacitor having a useful service live without deterioration or failure, that will not migrate into the ceramic matrix under high temperature, and is particularly adapted to spark plug assembly operations without succumbing to chemical oxidation or mechanical destruction through abrasion.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
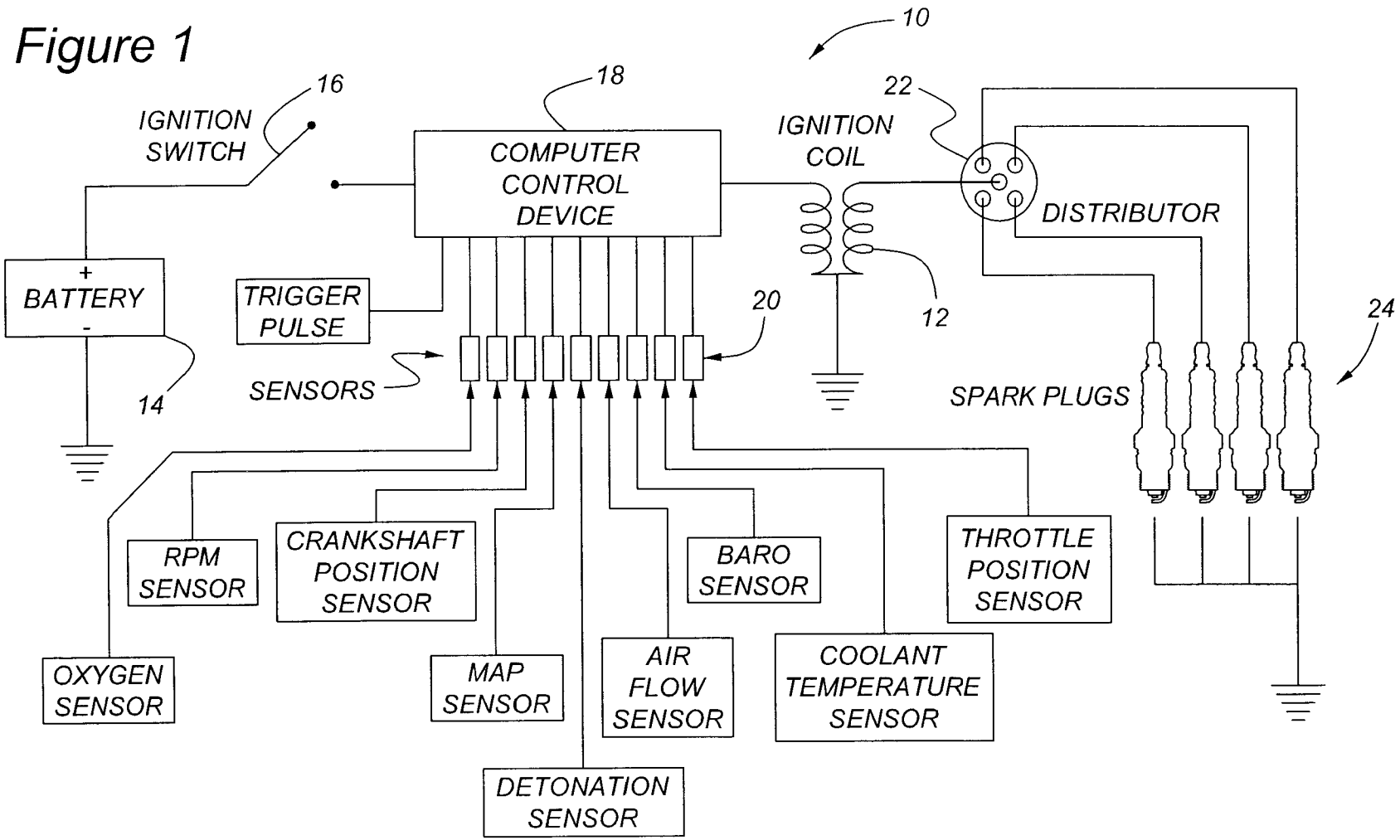
FIG. 1 is a simplified schematic view of an exemplary ignition system for a spark-ignited internal combustion engine.

Referring to the Figures, wherein like numerals indicate like or corresponding parts throughout the several views, an exemplary ignition system for a spark-ignited internal combustion engine is generally shown at 10 in FIG. 1. The ignition system 10 can be of any known type, including the standard ignition system with contact points, a breakerless electronic ignition system, a capacitor discharge ignition system, or the like. In the example of FIG. 1, a computer controlled ignition system is depicted, whose primary purpose is to provide a timed electrical discharge of sufficient energy to ignite a compressed air/fuel mixture in the individual cylinders of an internal combustion engine. The voltage needed to produce this electrical discharge is most often generated by means of an auto-transformer where the current in the primary of an ignition coil 12 is interrupted at the desired time of ignition. This is accomplished by a circuit in which the relatively low voltage in a battery 14 is stepped up to the order of 30 to 40 kilovolts or by means of a self-contained magneto. When an ignition switch 16 is in the "on" or "closed" condition, current flows from the battery 14 to a computer control device 18 which is programmed to determine the exact time when ignition is required and to send a signal to the ignition coil 12 to produce the high voltage needed for firing the spark plugs. Sensors, generally indicated at 20, provide numerous inputs to the computer control device 18 which allow it to compute precise timing parameters. A distributor 22 acts as a switching device for directing high-tension voltage from the coil 12 in precisely timed intervals to the respective combustion chambers in the engine. Those skilled in the art will appreciate that the specific arrangement, circuitry and components in the ignition system 10 may vary by application and as technology evolves.

Figure 2:
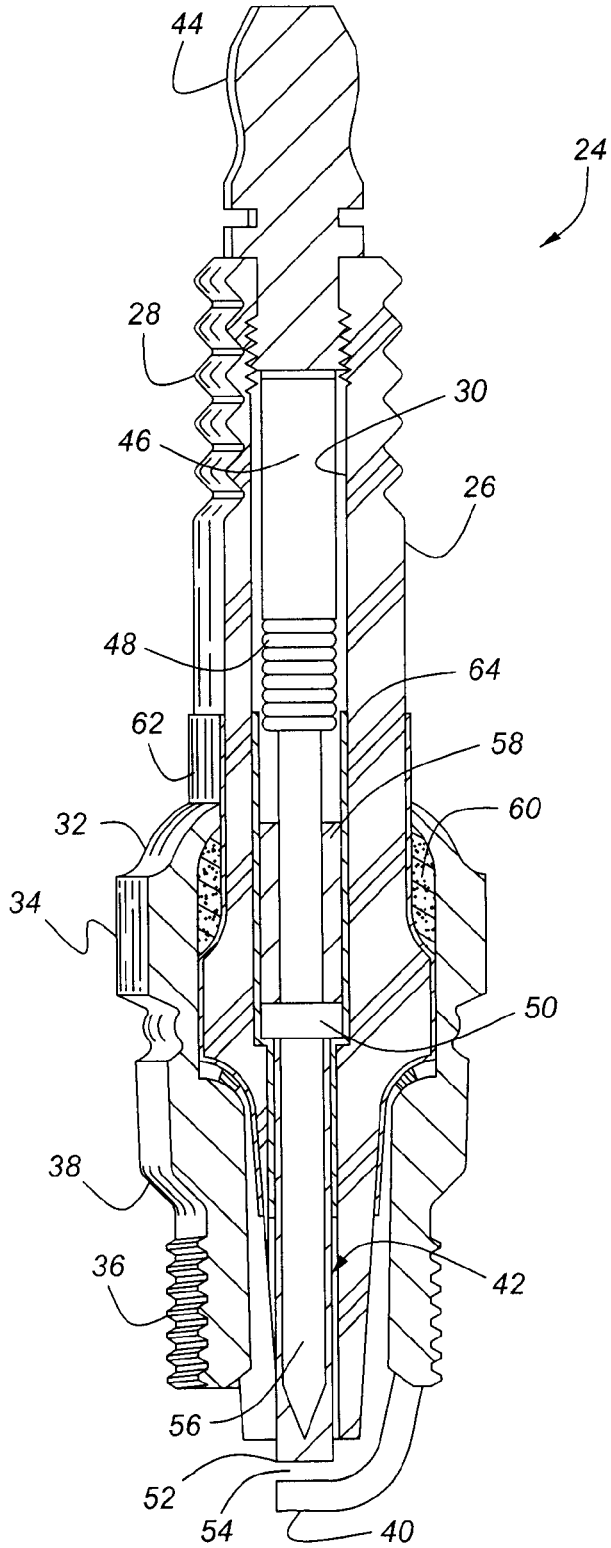
FIG. 2 is a cross section of an exemplary spark plug incorporating the novel features of the subject invention.
Figure 3:
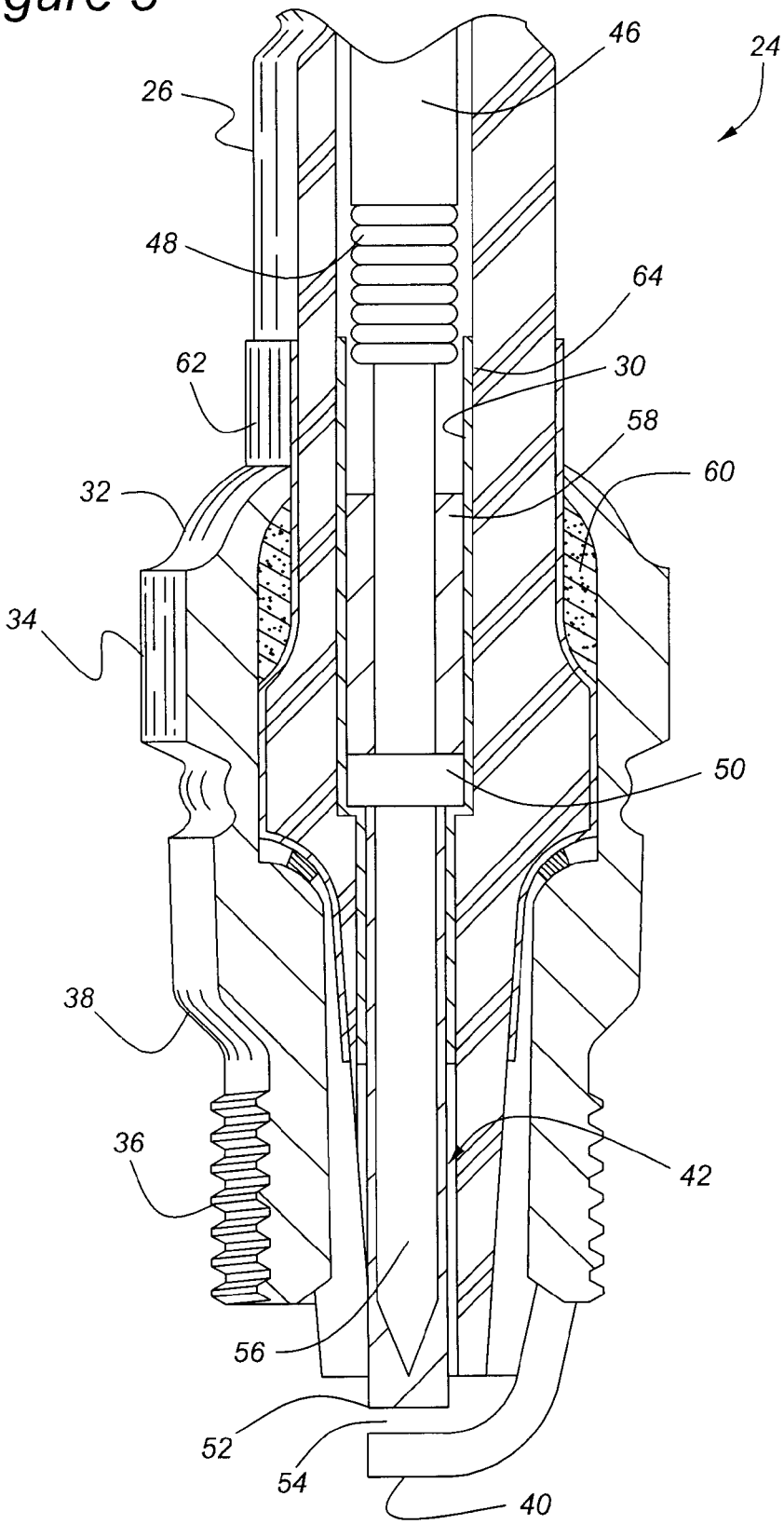
FIG. 3 is an enlarged view of the spark plug of FIG. 2.

A spark plug is generally shown at 24 in FIGS. 2 and 3. The spark plug 24 includes a generally tubular ceramic insulator 26 which is preferably made from an aluminum oxide ceramic material having a specified dielectric strength, high mechanical strength, high thermal conductivity and excellent resistance to heat shock. The insulator 24 may be molded dry under extreme pressure, and then kiln-fired to vitrification at high temperature. The insulator 26 has an outer surface which may include ribs 28 for the purpose of providing added protection against spark or secondary voltage "flash-over" and improve grip of a rubber spark plug boot (not shown). The insulator 26 also includes a central passage extending the length of the insulator 26 and defined by an inner surface 30.

A metallic shell 32 surrounds the lower section of the outer surface of the insulator 26. The metallic shell 32 may be fabricated by a cold-extrusion or other process, and include a tool receiving hexagon 34 for removal and installation purposes. The hex size complies with industry standards for the related application. A threaded section 36 is formed at the lower portion of the metallic shell 32, immediately below a seat 38. The seat 38 may either be tapered to provide a close tolerance installation in a cylinder head which is designed for this style of spark plug, or may be provided with a gasket (not shown) to provide a smooth surface against which the spark plug seats in the cylinder head. A ground electrode 40 extends radially inwardly from the bottom of the threaded section 36. The ground electrode 40 may be fabricated from a material different than that of the metallic shell 32, so as to resist both sparking erosion and chemical corrosion under normal and extreme operating temperature conditions, and to conduct heat. The round electrode 40 may have a rectangular cross-section to provide increased gap life, but other shapes and configurations are also possible, including the use of multiple ground electrodes, annular ground electrodes, or surface gap type electrodes, to name but a few.

A center electrode, generally indicated at 42, is disposed in the central passage of the ceramic insulator 26, in registry with the inner surface 30. The center electrode 42 preferably comprises an assembly which, in the example of FIG. 2, includes an upper terminal end 44 that can be secured within the central passage of the insulator 26 by threads coupled with an applied cement to provide a permanent, gas-tight connection. A suppressor 46 can be included in-line under the upper terminal end 44 for the purpose of reducing electromagnetic interference in certain situations. The suppressor 46 can be of any known type, including the resistive type or the inductive type, depending in part on the configuration of the ignition system 10. A spring 48 assures firm contact between the suppressor 46 and the upper terminal end 44. A lower portion 50 of the center electrode 42 abuts the under side of the spring 48 and extends through the remainder of the central passage in the insulator 26 to emerge at a lower sparking end 52 presented in opposing relation to the ground electrode 40. A spark gap 54 is defined in the space between the sparking end 52 and the ground electrode 40. The lower portion 50 of the center electrode 42 may include encapsulated copper 56 to improve heat transfer away from the spark gap 54. A compacted powder seal 58 may be formed under high pressure between the lower portion 50 of the center electrode 42 and the inner surface 30 of the insulator 26 to provide a permanent assembly and eliminate combustion gas leakage. The powder seal 58 is of the type impervious to heat, oxidation, and corrosion. A similar powder seal 60 may be provided between the metallic shell 32 and the outer surface of the insulator 26. Those skilled in the art will appreciate that the specific construction and configuration of the center electrode 42 can take many forms and may even evolve with technological advances. It can be inserted into the ceramic insulator 26 as a unit, but more preferably is assembled in situ. The sparking surfaces of the center 42 and ground 40 electrodes can be fitted with precious metals to improve durability.

The spark plug 24 is fitted with an integrated capacitor for the purpose of increasing the intensity of the spark generated in the spark gap 54. The integrated capacitor is formed by an outer metallic film 62 applied over at least a portion of the outer surface of the insulator 26 so that it is in contact with the grounded metallic shell 32. This outer metallic film 62 forms one plate of the capacitor. An inner metallic film 64 is disposed over a corresponding portion of the inner surface 30 of the insulator 26 and is in electrical contact with the center electrode 42. The inner metallic film 64 forms the other plate of the capacitor configuration. The insulator 26, positioned between the outer 62 and inner 64 metallic films, forms a dielectric and is operative to sustain a capacitive electrical field therein for discharge with a spark formed in the spark gap 54. As high tension electricity is applied to the center electrode 42, the electrical potential between the grounded metallic shell 32 and the center electrode 42, which are respectively conducted to the outer 62 and inner 64 metallic films, creates an integrated electrical device when the two films 62, 64 are electrically insulated from each other by the dielectric insulator 26 and in which capacitance is introduced in the form of stored electrical energy. When a spark forms in the spark gap 54, the capacitor is discharged, with the effect that the stored electrical energy is transmitted into the spark thereby increasing its intensity and its effectiveness in igniting the air/fuel mixture in the cylinder.

Preferably, the inner 64 and outer 62 metallic films are applied about the full circumferential measure of the insulator 26 so that, like the tubular insulator 26, each metallic film 62, 64 takes the form of a tube, or body of revolution, concentric about the center electrode 42. The axial extent to which each metallic film 62, 64 covers the insulator 62 can be varied depending upon the spark plug configuration and particular applications. In the examples shown, the outer metallic film 62 extends above the shell 32 and presents an exposed portion visible upon external examination of the finished spark plug 24. In the other direction, the outer metallic film 62 extends partly down the insulator nose so that some of its surface area is exposed to combustion gasses. Internally, the inner metallic film 64 is generally coextensive in the axial direction with the outer metallic film 62.

In order to prevent oxidation of the metallic films 62, 64 under high temperature operations, and also to prevent diffusion of an electrically conductive element into the matrix of the insulator 26, the metallic films 62, 64 are preferably made from a noble metal coating of gold or a member of the platinum group which consists of platinum, palladium, iridium, osmium, ruthenium, and rhodium. Another possible material for the metallic films 62, 64 comprises copper, however to address oxidation issues, the copper may be coated with a protective layer such as a glazing.

Figure 4:
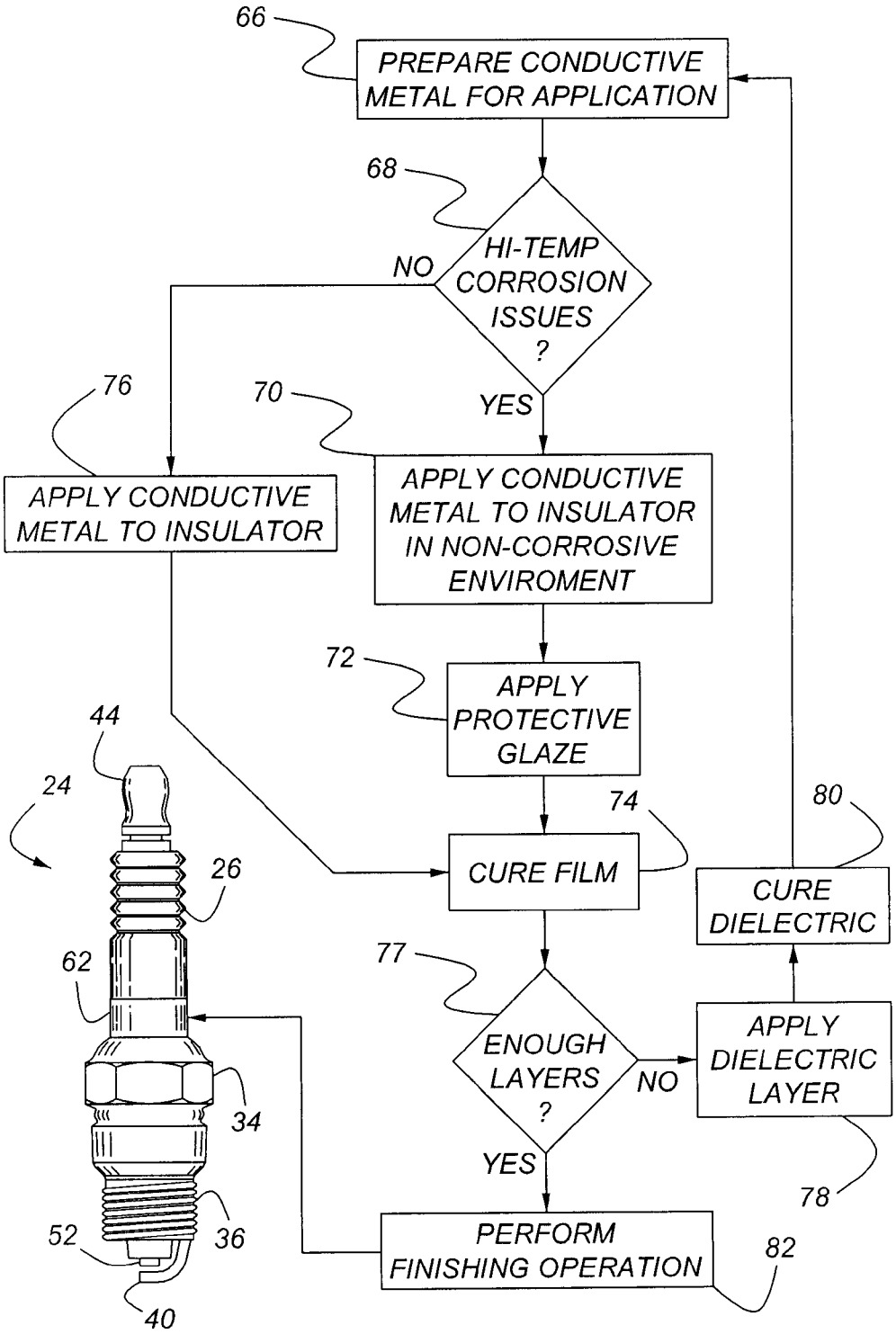
FIG. 4 is a schematic diagram showing a sequential method of applying metallic film to the ceramic insulator.

The inner 62 and outer 64 metallic films can be applied as coatings or intermixed with the ceramic glazing material and applied as part of the normal glaze process. FIG. 4 illustrates an exemplary sequence of events in which the inner 64 and outer 62 metallic films are applied as coatings. Here, operation box 66 represents the stage in which the conductive metal is prepared for application. Generally, this will involve formulating the specific material into a liquid state. It can also involve formulating the material as an ink or paint made from the constituent material. Other possibilities include preparing the conductive metallic material as a powder to be applied in a pre-sintering operation. Decision block 68 queries whether the particular material possesses sufficient high temperature corrosion properties. If not, such as in the example of copper, the conductive metal may be applied to the insulator 26 in a non-corrosive environment like nitrogen or argon atmosphere. This is represented in function block 70. Following this, a protective glaze or other non-corrosive coating is applied over the metallic film to address high temperature corrosion issues. This step is conducted at function block 72, followed by a curing operation 74. If, instead of copper, gold or one of the platinum group metals is chosen for the conductive metal, the conductive metal can be applied directly to the insulator 26 as represented in function block 76, followed by the curing operation 74, as corrosion will not be an issue. In the example of the conductive metals being prepared in the form of a liquid ink or paint, application to the insulator 26 can take the form of brushing, dipping, rolling, spraying, screening, or any other known operation for applying a liquid coating to a rigid substrate.

Figures 6, 6A, 6B:
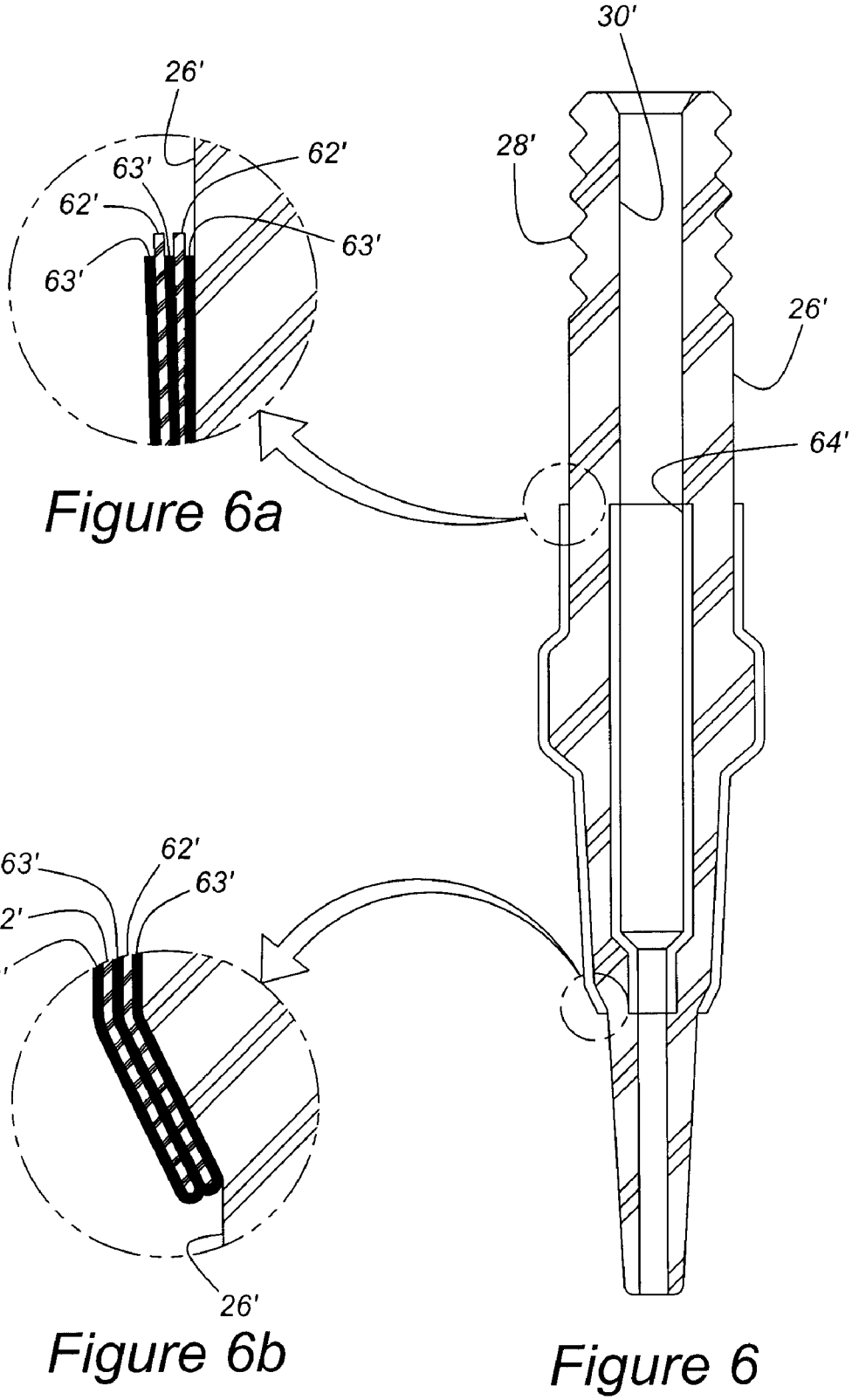
FIG. 6 is a cross-sectional view of an insulator according to a first alternative embodiment.
FIGS. 6*a* and 6*b* are enlarged views of the respective circumscribed regions of FIG. 6.

In some applications, it may be desirable to enhance the capacitance of the spark plug by applying the inner and/or the outer metallic films in multiple layers interlaced with layers of an insulator material such as a glaze or other high dielectric constant material. Reference is made to FIGS. 6, 6*a* and 6*b*, where prime designations are applied to the previously introduced reference numbers. Here, the outer metallic film is depicted as a pair of ganged micro-plates 62' separated by a non-conducting interlayer 63'. The pair of ganged micro-plates 62' effectively double the surface area of the outer metallic film, thereby substantially enhancing its charge-carrying capacity. Although not shown, the inner metallic film 64' can be made in the same ganged fashion as the outer metallic film. More than two ganged micro-plates 62' are possible. This alternative design has the advantage of increasing the effective surface area of the capacitor without substantially increasing the axial length or the radial diameter of the spark plug 24' beyond specified dimensions.

Figures 7, 7A, 7B:
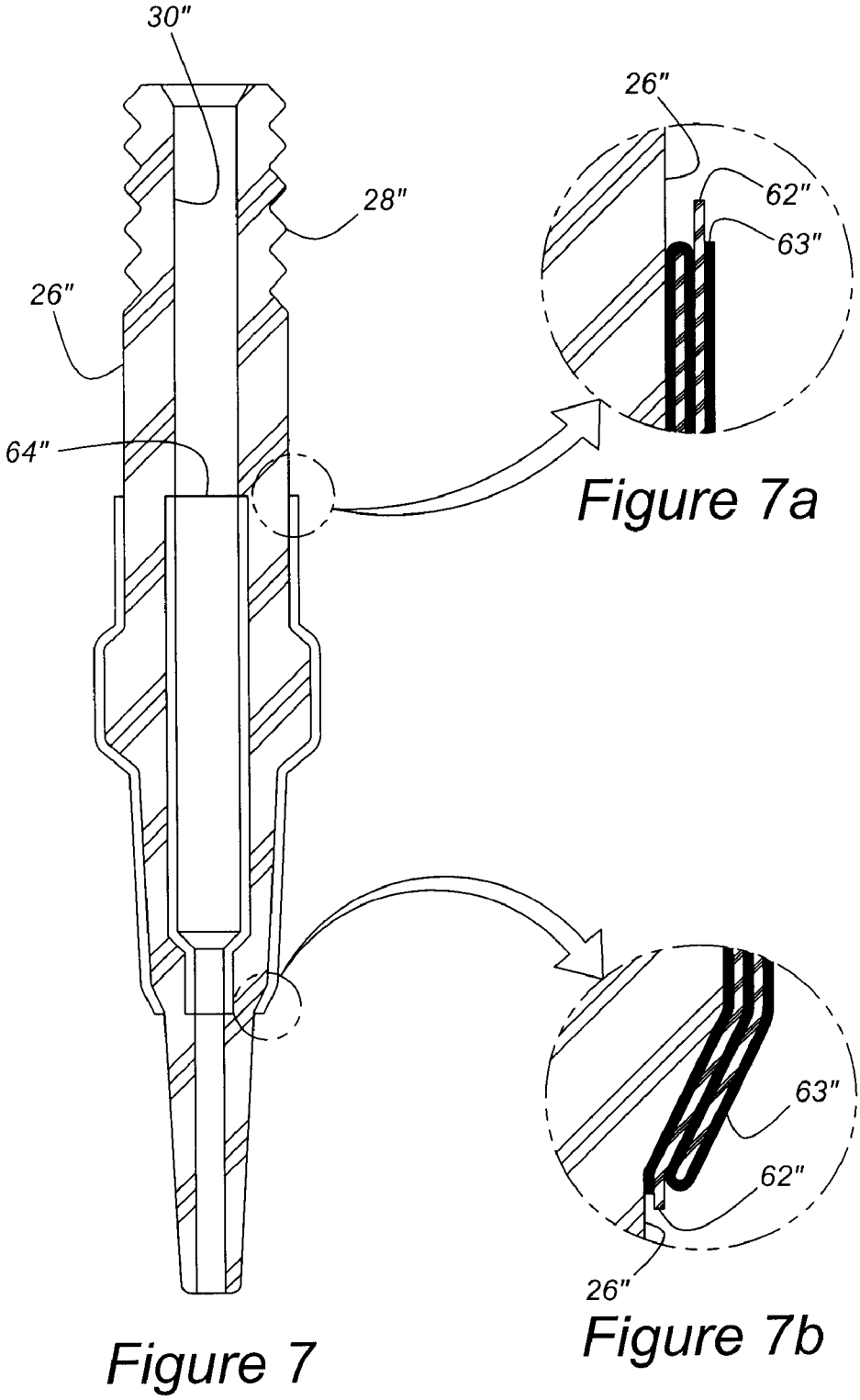
FIG. 7 is a cross-sectional view of an insulator according to a second alternative embodiment.
FIGS. 7*a* and 7*b* are enlarged views of the respective circumscribed regions of FIG. 7.

In FIGS. 7, 7*a* and 7*b*, a second alternative embodiment of this invention is illustrated. Double prime designations are applied to previously-presented reference numbers for the sake of convenience. In this embodiment, the outer metallic film is shown as a serpentine micro-plate 62" folded twice upon itself, together with a non-conducting interlayer 63". The resulting construction presents three times the charging surface area as compared to the embodiment of FIGS. 2 and 3. The inner metallic film 64" can likewise be formed with a serpentine micro-plate, or with ganged micro-plates as in FIGS. 6*a* and 6*b*, or with a single layer as in FIGS. 2 and 3. Also, it is possible to fold the micro-plate 62" and interlayer 63" more than twice upon itself, thereby creating more than three layers in the construction.

In view of these first and second alternative embodiments, the sequence of events presented in FIG. 4 may then include a query 77 to determine whether enough layers of metallic film have been applied. If the answer is "NO" the procedure may advance to function block 78 where a dielectric layer is applied, followed by a curing of the dielectric 80 if necessary. The sequence is then repeated to apply another layer of metallic film. This loop is repeated until the query 77 has been answered in the affirmative. From here, final finishing operations can be performed at functional block 82, with the resulting spark plug 24' according to the subject invention being produced as an end product.

Figure 5:
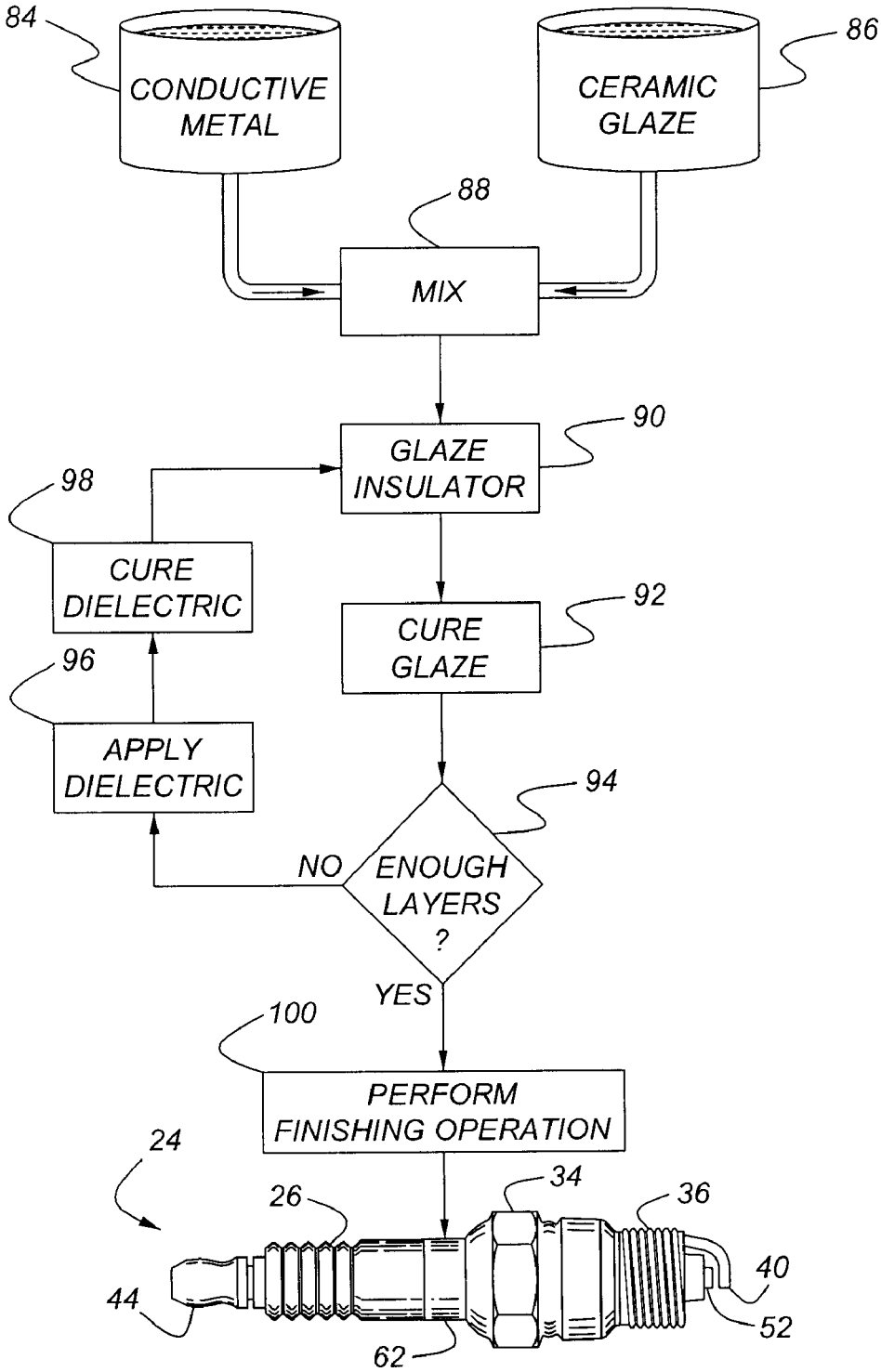
FIG. 5 is a schematic diagram as in FIG. 4, but showing an alternative method for applying the metallic film to the ceramic insulator.

An alternative application technique is described in connection with FIG. 5. Here, an appropriate conductive metal is provided in a container 84, together with a ceramic glaze material in a container 86. These constituents are mixed together to form an extremely durable, high temperature conductive coating for the insulator 26. According to this technique, even a material like copper, which has a propensity toward chemical oxidation under high temperature conditions, is protected from corrosion and from migration into the matrix of the insulator 26. The specially prepared glaze is then applied to the insulator 26 at function block 90. The glaze is cured at 92 so that the resulting conductive coating is fully set and operational. Query block 94 determines whether multiple layers of the conductive coating are to be applied. If so, it may be necessary to form another dielectric layer at 96, and cure that dielectric layer at 98 before applying a new layer of glaze at 90. However, if only one layer of metallic film is to be applied, or when enough layers have been achieved, the insulator 26 is subjected to further finishing operations 100 to yield a fully finished spark plug 24 according to the subject invention.

Obviously, many modifications and variations of the present invention are possible in light of the above teachings. It is, therefore, to be understood that within the scope of the appended claims, the invention may be practiced otherwise than as specifically described.

What is claimed is:

1. A spark plug for a spark-ignited internal combustion engine, said spark plug comprising:

a generally tubular ceramic insulator comprising a single piece of insulating material extending continuously along a length and having an outer surface and an inner surface along said length;

a metallic shell disposed about said outer surface of said ceramic insulator, said shell including at least one ground electrode;

a center electrode disposed in said ceramic insulator in registry with said inner surface thereof, said center electrode having an upper terminal end and a lower sparking end in opposing relation to said ground electrode with a spark gap defining the space therebetween;

and said ceramic insulator including an outer metallic film disposed over said outer surface in electrical contact with said shell, and an inner metallic film disposed over said inner surface in electrical contact with said center electrode, said inner and outer metallic films electrically separated from one another by said ceramic insulator and operative to store a charge of electrical energy therebetween in response to an electrical potential between said center electrode and said shell and wherein said inner and outer metallic films extend over only a portion of said length of said ceramic insulator and, wherein said inner and outer metallic films are coextensive in length.

2. The spark plug of claim 1 wherein said ceramic insulator comprises a body of revolution having a circumference, said inner and outer metallic films extending the full circumferential measure about said respective inner and outer surfaces.

3. The spark plug of claim 1 wherein said inner and outer metallic films comprise an applied coating.

4. The spark plug of claim 1 wherein said inner and outer metallic films comprise a glazing mixture.

5. The spark plug of claim 1 wherein said inner and outer metallic films comprise an electrically conductive metal selected from the group consisting of: Gold, Copper, Platinum, Rhodium, Iridium, Palladium, Osmium and Ruthenium.

6. The spark plug of claim 5 further including a protective coating applied over said inner and outer metallic films.

7. The spark plug of claim 1 wherein at least one of said inner and outer metallic films includes a plurality of discrete metallic layers ganged together as micro-plates and separated from one another by a corresponding plurality of electrical insulator layers.

8. The spark plug of claim 7 wherein said electrical insulator between said discrete metallic layers comprises a glaze material.

9. The spark plug of claim 1, wherein at least one of said inner and outer metallic films includes a serpentine micro-plate and an electrical insulator layer folded upon themselves as a unit.

10. The spark plug of claim 9 wherein said electrical insulator layer comprises a glaze material.

11. An ignition system for a spark ignited internal combustion engine, said ignition system comprising:

an electrical source;

an ignition coil operatively connected to said electrical source for creating a high tension voltage;

a switching device operatively connected to said ignition coil for distributing the high tension voltage from said coil in precisely timed intervals;

at least one spark plug electrically connected to said switching device, said spark-plug including a generally tubular ceramic insulator comprising a single piece of insulating material extending continuously along a length and having an outer surface and an inner surface along said length, a metallic shell disposed about said outer surface of said ceramic insulator, said shell including at least one ground electrode, a center electrode disposed in said ceramic insulator in registry with said inner surface thereof, said center electrode having an upper terminal end and a lower sparking end in opposing relation to said ground electrode with a spark gap defining the space therebetween, and said ceramic insulator including an outer metallic film disposed over said outer surface in electrical contact with said shell, and an inner metallic film disposed over said inner surface in electrical contact with said center electrode, said ceramic insulator forming a dielectric between said inner and outer metallic films and operative to sustain an electric field therein for discharge with a spark formed in said spark gap, and wherein said inner and outer metallic films extend over only a portion of said length of said ceramic insulator and wherein said inner and outer metallic films are coextensive in length.

12. The ignition system of claim 11 wherein said ceramic insulator comprises a body of revolution having a circumference, said inner and outer metallic films extending the full circumferential measure about said respective inner and outer surfaces.

13. The ignition system of claim 11 wherein said inner and outer metallic films comprise an applied coating.

14. The ignition system of claim 11 wherein said inner and outer metallic films comprise a glazing mixture.

15. The ignition system of claim 11 wherein said inner and outer metallic films comprise an electrically conductive metal selected from the group consisting of: Gold, Copper, Platinum, Rhodium, Iridium, Palladium, Osmium and Ruthenium.

16. The ignition system of claim 15 further including a protective coating applied over said inner and outer metallic films.

17. The ignition system of claim 11 wherein at least one of said inner and outer metallic films includes a plurality of discrete metallic layers ganged together as micro-plates and separated from one another by a corresponding plurality of electrical insulator layers.

18. The ignition system of claim 17 wherein said electrical insulator between said discrete metallic layers comprises a glaze material.

19. The ignition system of claim 11, wherein at least one of said inner and outer metallic films includes a serpentine micro-plate and an electrical insulator layer folded upon themselves as a unit.

20. The ignition system of claim 19 wherein said electrical insulator layer comprises a glaze material.

21. The spark plug of claim 1 wherein said inner and outer metallic layers extend longitudinally beyond an upper end of said metallic shell.

22. A spark plug for a spark-ignited internal combustion engine, said spark plug comprising:

a generally tubular ceramic insulator having an outer surface and an inner surface;

a metallic shell surrounding at least a portion of said outer surface of said ceramic insulator, said shell including at least one ground electrode;

a center electrode disposed in said ceramic insulator in registry with said inner surface thereof, said center electrode having an upper terminal end and a lower sparking end in opposing relation to said ground electrode with a spark gap defining the space therebetween;

said ceramic insulator including an outer metallic film disposed over at least a portion of said outer surface in electrical contact with said shell, and an inner metallic film disposed over at least a portion of said inner surface in electrical contact with said center electrode, said inner and outer metallic films electrically separated from one another by said ceramic insulator and operative to store a charge of electrical energy therebetween in response to an electrical potential between said center electrode and said shell, and wherein at least one of said inner and outer metallic films includes a plurality of discrete metallic layers ganged together as micro-plates and separated from one another by an associated plurality of insulating layers.

* * * * *